US007320267B1

(12) United States Patent
Chen

(10) Patent No.: US 7,320,267 B1
(45) Date of Patent: Jan. 22, 2008

(54) RATCHET BOX END WRENCH

(76) Inventor: Yu-Tang Chen, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 11/645,349

(22) Filed: Dec. 26, 2006

(51) Int. Cl.
*B25B 13/00* (2006.01)
*B25B 17/00* (2006.01)
*B25B 13/46* (2006.01)

(52) U.S. Cl. ..... 81/58.1; 81/57.3; 81/57.43

(58) Field of Classification Search ..... 81/58.1, 81/57.3, 57.43, 180.1, 177.4
See application file for complete search history.

(56) References Cited

U.S. PATENT DOCUMENTS 322,937 A * 7/1885 Hungerfod ..... 81/57.3
3,283,621 A * 11/1966 Faso ..... 81/58.1
4,184,390 A * 1/1980 Evans ..... 81/57.3
5,129,823 A * 7/1992 Hughes ..... 433/141
5,458,603 A * 10/1995 Futch, Sr. ..... 606/104
5,461,949 A * 10/1995 Carver ..... 81/57.3
5,775,182 A * 7/1998 Plakinger ..... 81/57.3

* cited by examiner

*Primary Examiner*—Hadi Shakeri

(57) ABSTRACT

A ratchet box end wrench includes a shank, a ratchet, a ring gear, three wheel members, a belt and a crank. The shank includes a space defined therein, a first pivot hole defined therein and a second pivot hole in communication with the first pivot hole. The ratchet includes a ratchet portion disposed in the space and an axial portion extended from the ratchet portion. The ring gear is connected to the axial portion of the ratchet. The first wheel member includes a pivot disposed in the first pivot hole. The belt is engaged with both of the ratchet and the first wheel member. The second wheel member is connected to the first wheel member so that the first and second wheel members are rotational together. The crank is operatively connected to the second wheel member. The third wheel member is operatively connected to the first wheel member.

7 Claims, 13 Drawing Sheets

A-A

RATCHET BOX END WRENCH

BACKGROUND OF THE INVENTION

1. Field of the Invention

The present invention is related to a ratchet box end wrench, and more particularly, to one that allows fast rotation.

2. Description of the Prior Art

As taught in U.S. Pat. Nos. 5,522,288, 6,044,731, 5,957,009, and 6,282,992, a conventional wrench including a shank, a driving mechanism, and control gears is found with the following flaws: a user has to drive the shank to rotate a fastener while rotating the wrench. A large torque is not required to drive the fastener when it has not been fully driven into a screw hole. Therefore, the process of driving the wrench to rotate the fastener is inconvenient.

SUMMARY OF THE INVENTION

A ratchet box end wrench includes a shank, a ratchet, a ring gear, a first wheel member, a second wheel member, a third wheel member, a belt, a fastener, a crank, a covering plate and a locking ring. The shank includes a space defined in an end, a first pivot hole defined in another end and a second pivot hole in communication with the first pivot hole. The ratchet includes a ratchet portion disposed in the space, an axial portion extended from the ratchet portion, a locating surface formed on the axial portion and a locking groove defined in the axial portion. The ring gear includes a straight portion formed on an internal side and engaged with the locating surface and a toothed portion on an external side. The first wheel member includes a toothed surface formed on the periphery, a linking block formed on a side, a pivot formed on an opposite side and disposed in the first pivot hole and a linking trough defined in the pivot. The belt includes a toothed internal side engaged with both of the ratchet portion of the ratchet and the toothed surface of the first wheel member. The second wheel member includes a linking block formed on a side and disposed in the linking trough so that the first and second wheel members are rotational together, a screw hole defined in the linking block and a cavity defined in an opposite side. The crank includes a linking block disposed in the cavity of the second wheel so that the crank is operable to rotate the second wheel member. The third wheel member includes a cavity for receiving the linking block of the first wheel member so that the third wheel member is operable to rotate the first wheel member and a countersink hole in communication with the cavity thereof. The fastener is driven in the screw hole of the second wheel member through the countersink hole and cavity of the third wheel member, the through hole and linking trough of the first wheel member. The covering plate includes a first through hole through which the axial portion of the ratchet is inserted and a second through hole through which the linking block of the first wheel member is inserted, wherein the covering plate is retained on the shank by the third wheel member for covering the ratchet, the ring gear, the belt and the first and second wheel members. The locking ring is disposed in the locking groove of the ratchet for further retaining the covering plate on the shank.

DETAILED DESCRIPTION OF THE PREFERRED EMBODIMENTS

Figure 1:
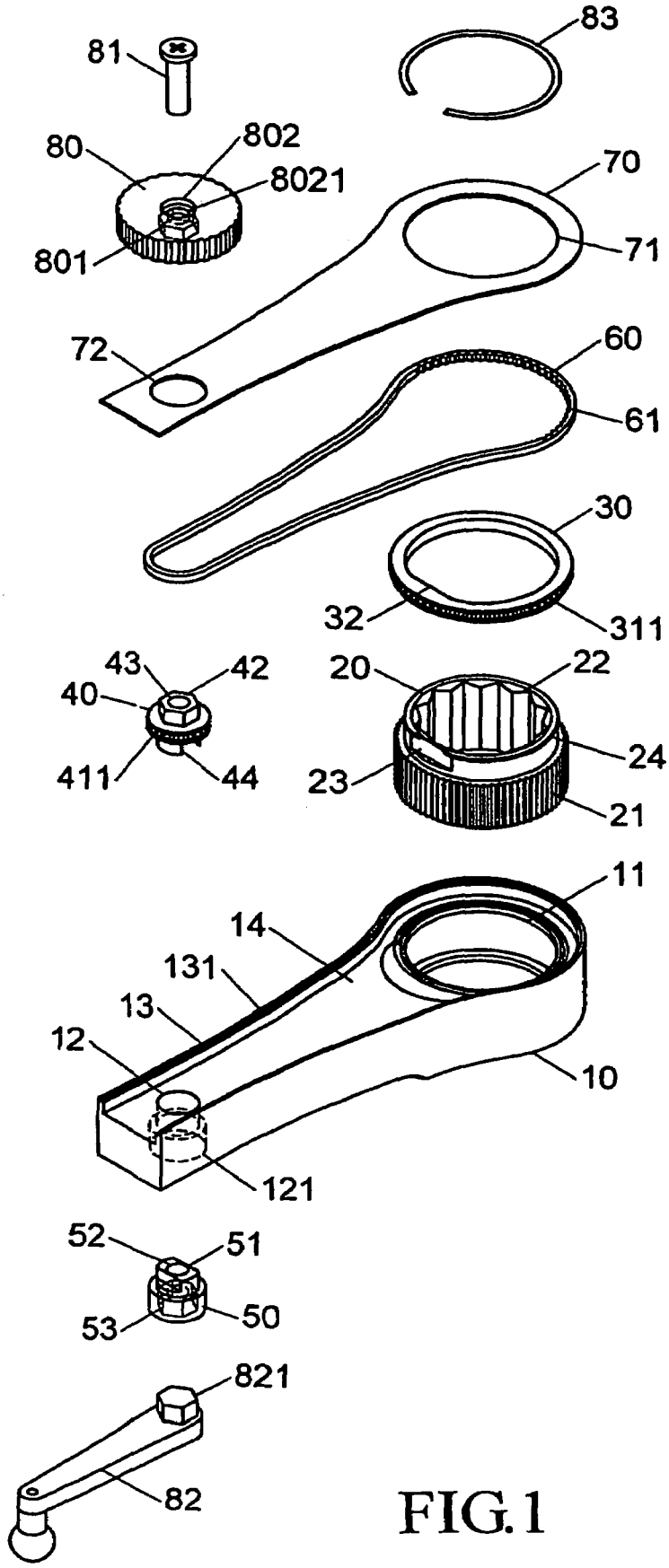
FIG. 1 is an exploded view of a first preferred embodiment of the present invention.

Referring to FIG. 1, a ratchet box end wrench of the present invention includes a shank 10, a ratchet 20, a ring gear 30, a first wheel member 40, a second wheel member 50, a transmission member 60, a covering plate 70, a third wheel member 80, a fastener 81, a crank 82, and a locking ring 83. The shank 10 has a space 11 defined in one end. A first pivot hole 12 is defined in the shank 10. A second pivot hole 121 is defined in the shank 10, in communication with the first pivot hole 12. A high wall 13 is provided along the edge of the shank 10. A short wall 131 extends against the high wall 13 and defines an accommodation space 14.

The ratchet 20 includes a ratchet portion 21, an axial portion 22 axially extended from the ratchet portion 21, a locating surface 23 formed on an external side of the axial portion 22 and a locking groove 24 defined in the external side of the axial portion 21. The ratchet portion 21 is rotationally disposed in the space 11. Moreover, the ratchet 20 includes a toothed internal side.

The ring gear 30 includes on an internal side a straight portion 32 for engagement with the locating surface 23 so that the ring gear 30 is not rotational on the axial portion 22 of the ratchet 20 when the ring gear 30 is placed on the axial portion 22 of the ratchet 20. The external side of the ring gear 30 is provided with a toothed surface 311.

The first wheel member 40 includes a toothed surface 411 formed on the periphery, a hexagonal linking block 42 formed on a side and a pivot 46 formed on an opposite side. A through hole 43 is axially defined in the first wheel member 40. A linking trough 44 is transversely defined in the pivot 46. The linking trough 44 is in communication with the through hole 43. The pivot 46 is rotationally disposed in the first pivot hole 12.

The second wheel member 50 includes a first portion 51 formed as a linking block 51 and a second portion 53 in which a hexagonal cavity 54 is defined. The linking block 51 is shaped corresponding to the first linking trough 44 for the second wheel 50 to be locked to the first wheel member 40 for coupled operation. A screw hole 52 is defined in the center of the second wheel member 50. The screw hole 52 is in communication with the through hole 43 when the linking block 51 is disposed in the first pivot hole 12 and the second portion 53 of the second wheel member 50 is disposed in the second pivot hole 121.

The transmission member 60 is related to a belt formed with a toothed portion 61 on an internal side. The transmission member 60 includes a portion that surrounds and engages with the toothed surface 311 and another portion that surrounds and engages with the first toothed surface 411 when the transmission member 60 is disposed in the accommodation space 14 of the shank 10.

The covering plate 70 is placed within the high wall 13 and on the short wall 131 and fixed to the shank 10 to seal up the ratchet 20, the ring gear 30, the first wheel member 40, and the transmission member 60 within the accommodation space 14. The covering plate 70 includes a through hole 71 to expose the axial portion 22 of the ratchet 20 and the locking groove 24 and another hole 72 through which the linking block 42 is exposed from.

The third wheel member 80 includes a hexagonal cavity 801 in a lower end and a countersink hole 802 in an upper end. The through hole 43 is in communication with the countersink hole 802 when the linking block 42 is disposed in the hexagonal cavity 801.

The fastener 81 is inserted into the countersink hole 802, the first through hole 43 and secured in the screw hole 52 while the upper end of the fastener 81 is disposed in the countersink hole 802. Thus, the third wheel member 80, the first wheel member 40, and the second wheel member 50 are retained in sequence to form an integral unit.

The crank 82 is provided with a hexagonal block 821. The hexagonal block 821 can be locked in the hexagonal cavity 54. Thus, the crank 82 is operable to drive the second wheel member 50.

The locking ring 83 is disposed in the locking groove 24 to retain the covering plate 70 on the short wall 131 while the axial portion 22 of the ratchet 20 is inserted through the through hole 71.

Figure 2:
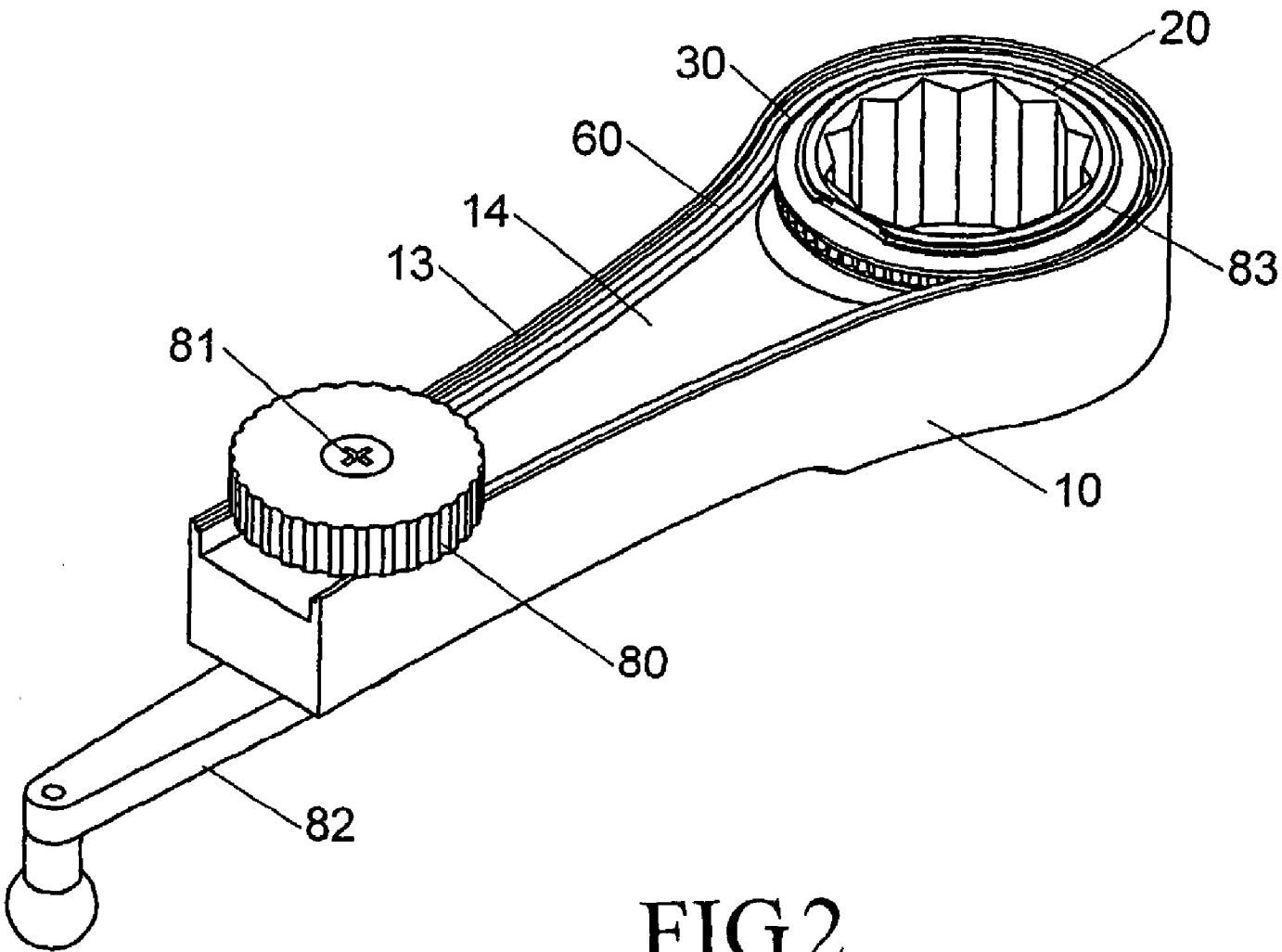
FIG. 2 is a perspective view of the first preferred embodiment of the present invention except a covering plate.
Figure 3:
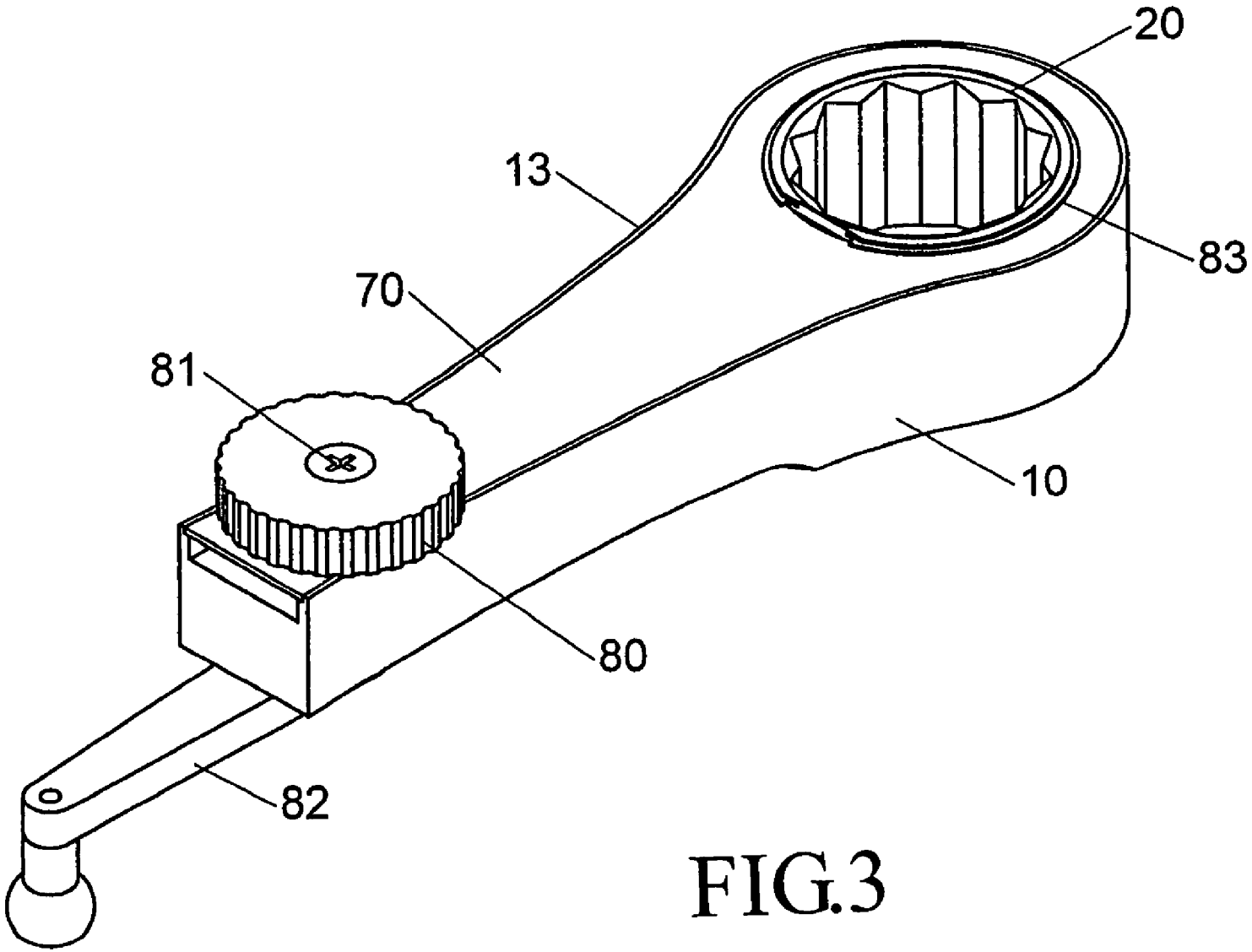
FIG. 3 is a perspective view showing the first preferred embodiment of the present invention as assembled.
Figure 4:
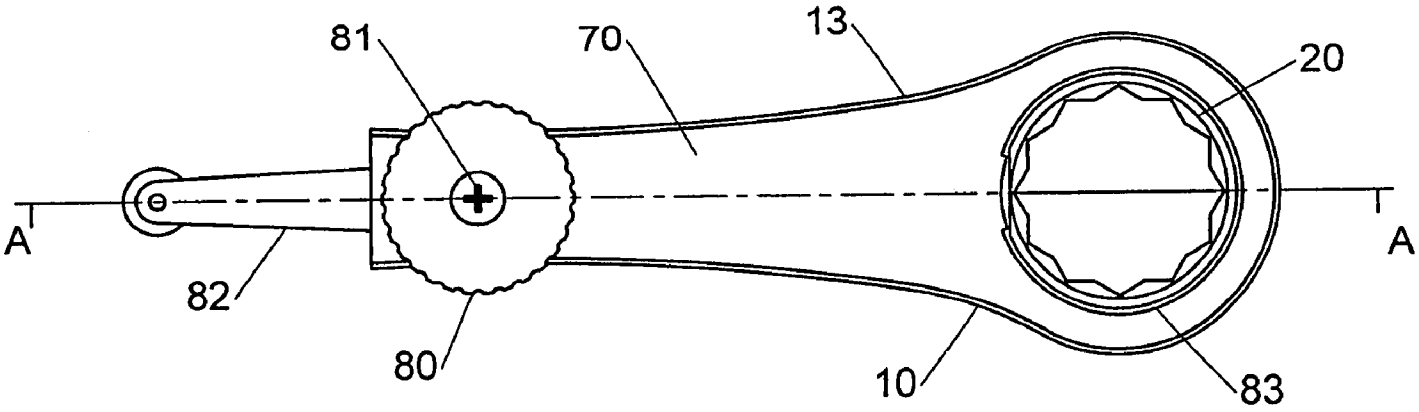
FIG. 4 is a top view of the first preferred embodiment of the present invention.
Figure 5:
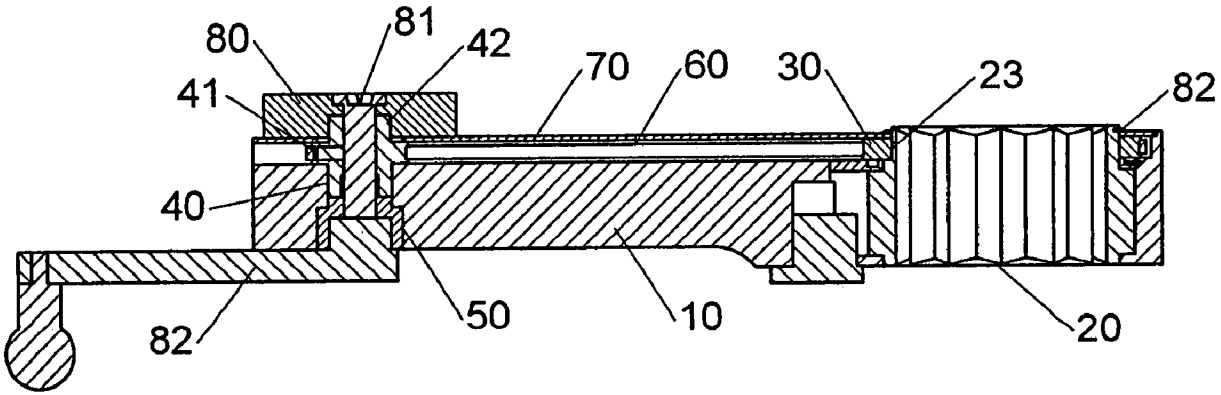
FIG. 5 is a cross-sectional view taken from A-A in FIG. 4.

The assembly of the ratchet box end wrench of the present invention without the covering plate 70 is illustrated in FIG. 2. The look of the ratchet box end wrench when the covering plated 70 is retained on the shank is shown in FIGS. 3, 4 and 5.

Figure 6:
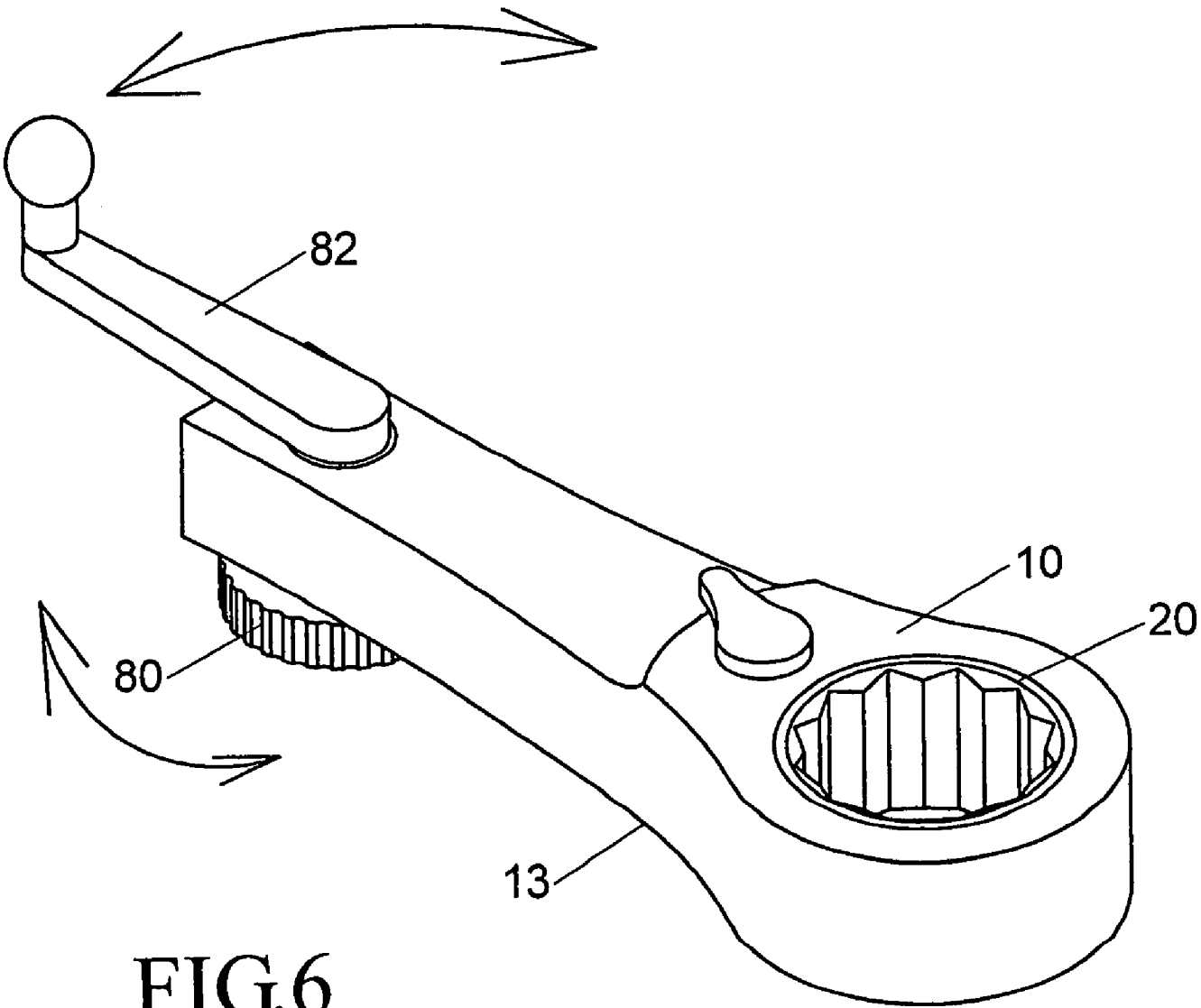
FIG. 6 is a schematic view showing the rotation status of the first preferred embodiment of the present invention.

Now referring to FIG. 6 for a schematic view of the operation of the present invention, the crank 82 drives the second wheel member 50, the first wheel member 40, the transmission member 60, the ring gear 30, and finally the ratchet 20 to rotate a fastener.

Figure 7:
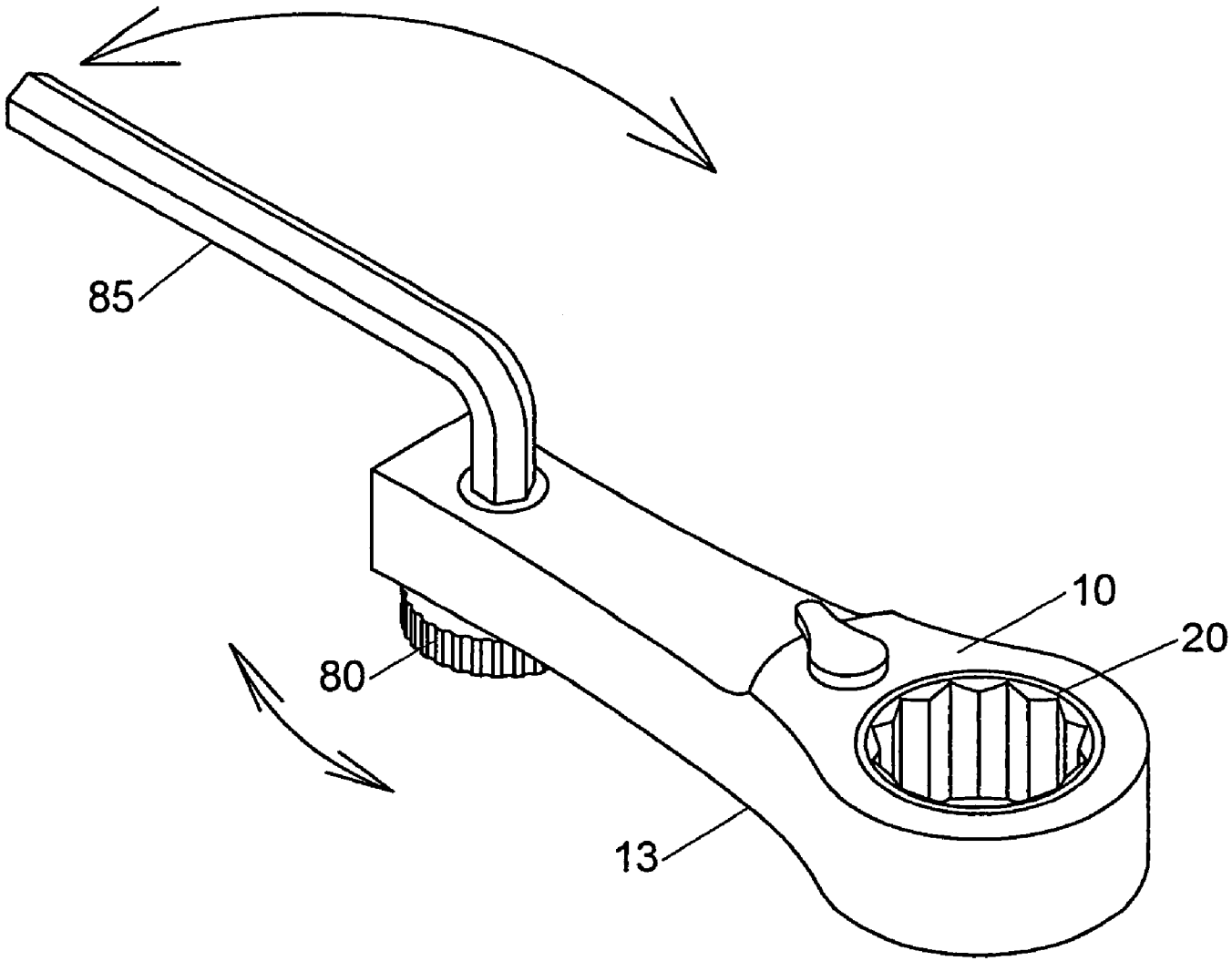
FIG. 7 is another schematic view showing the rotation status of the first preferred embodiment of the present invention.

Referring to FIG. 7, an end of an Allen key 85 is inserted in the hexagonal cavity 54. Thus, the Allen key 85 is operable to drive the second wheel member 50.

Figure 8:
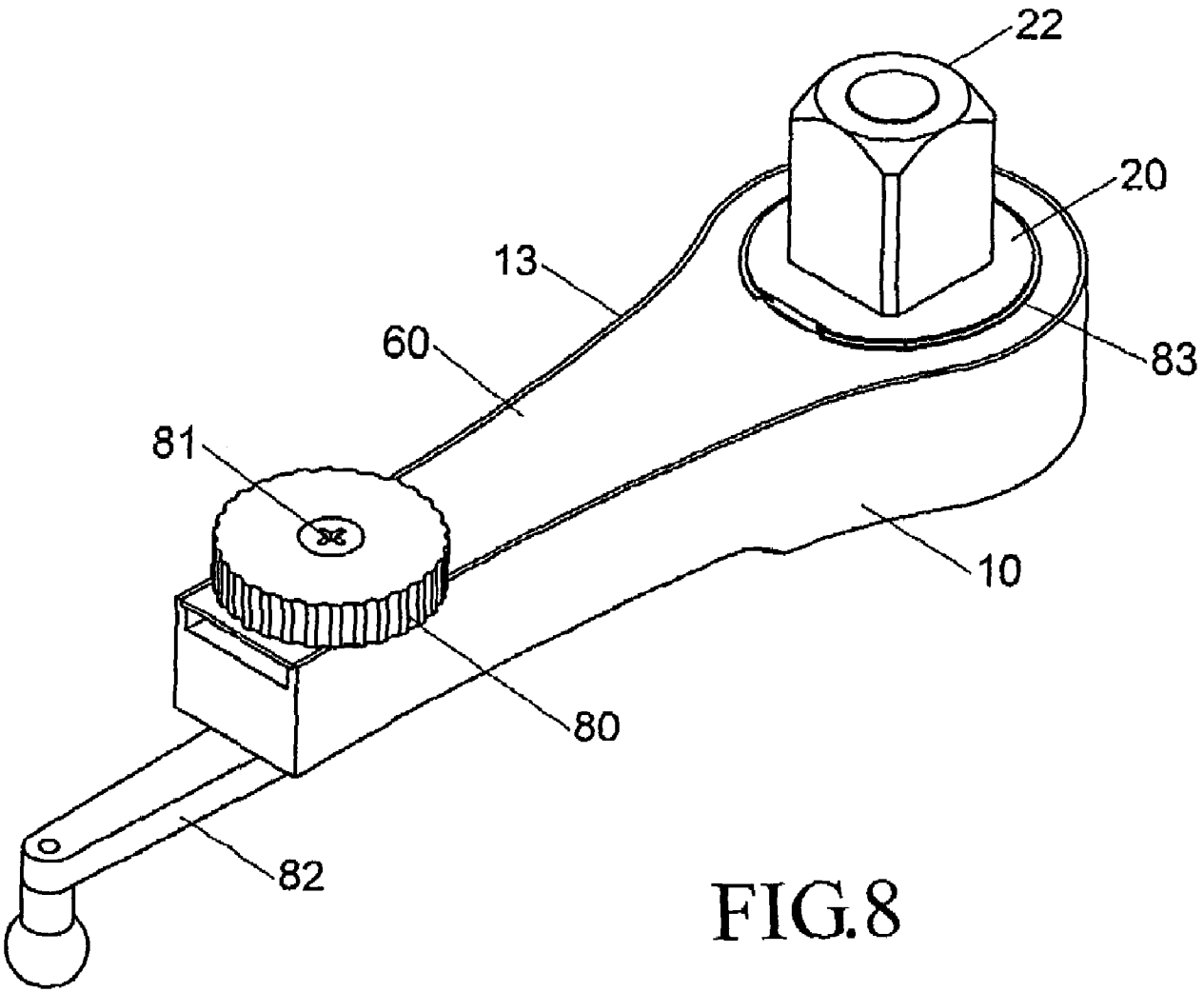
FIG. 8 is a perspective view of a second preferred embodiment of the present invention.

In a second preferred embodiment of the present invention as illustrated in FIG. 8, the axial portion 22 may be related to a protruded tetragonal head to be inserted in a sleeve.

Figure 9:
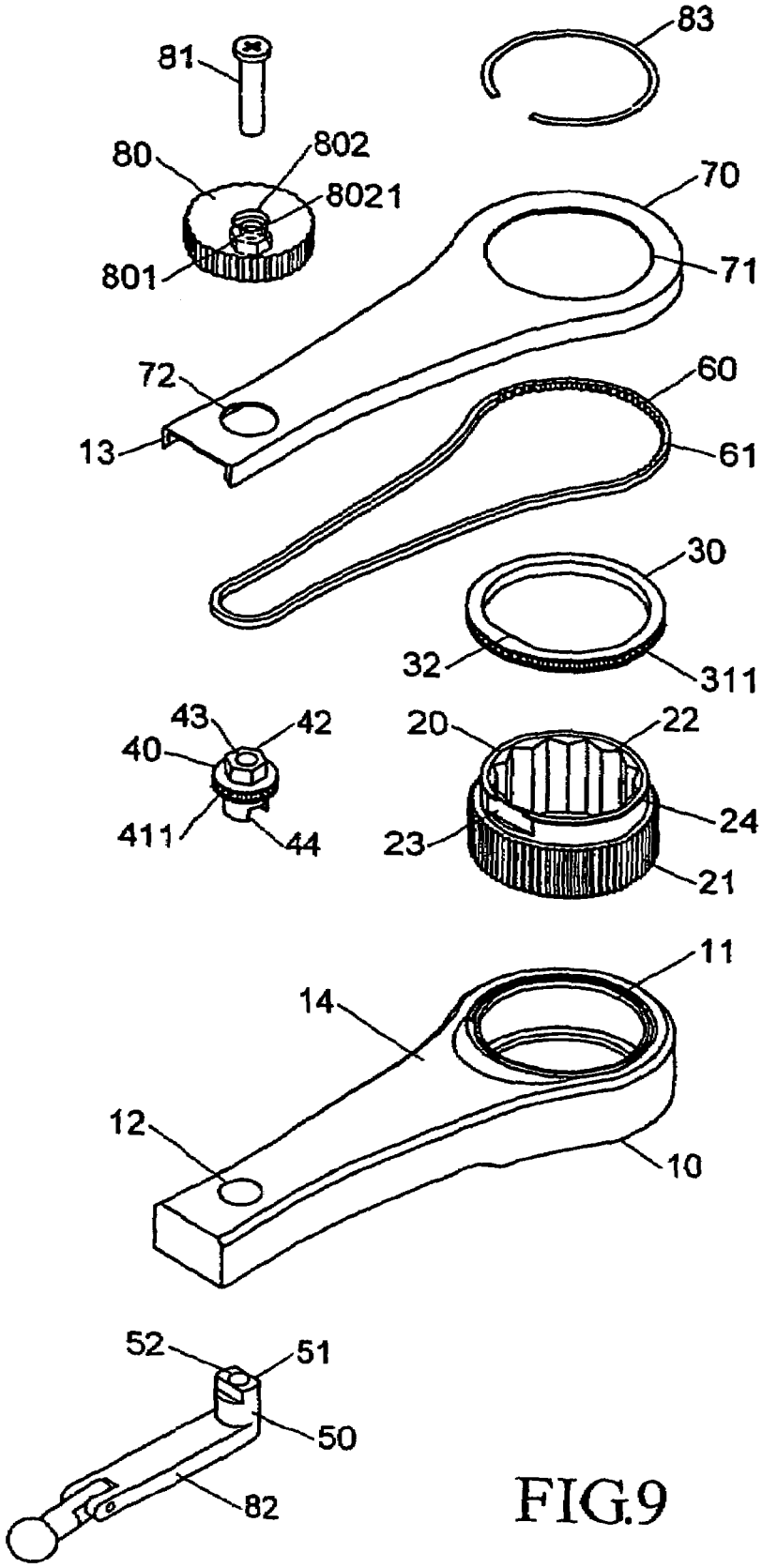
FIG. 9 is an exploded view of a third preferred embodiment of the present invention.
Figure 10:
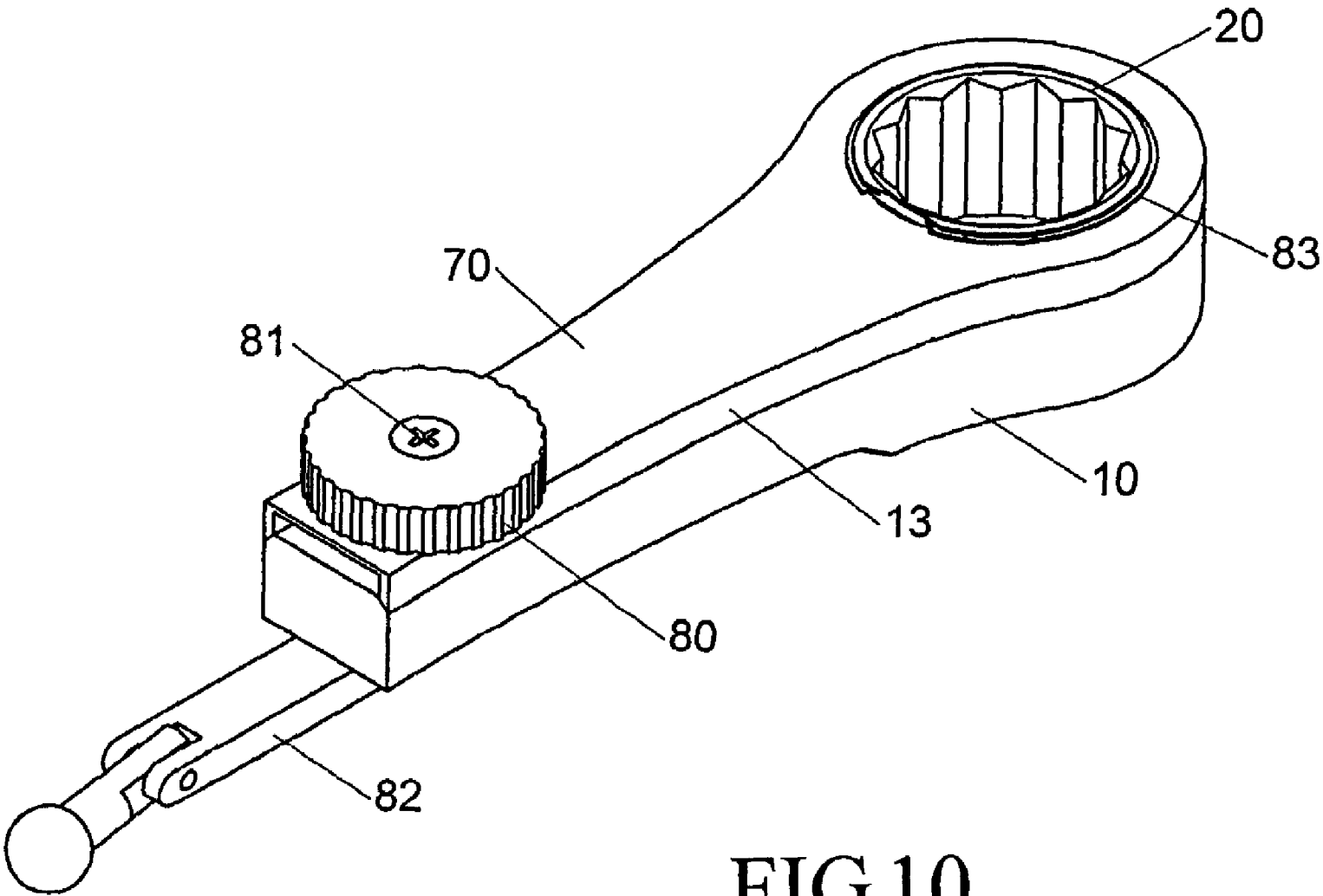
FIG. 10 is a perspective view showing the third preferred embodiment of the present invention as assembled.

As illustrated in FIG. 9, a third preferred embodiment of the present invention has the crank 82 integrated with the second wheel member 50. That is, the second portion 53 of the second wheel member 50 and the hexagonal block 821 of the crank 82 may become one. The shank 10 is not provided with the high wall 13. Instead, the covering plate 70 is provided with a wall 13; and when the covering plate 70 seals up the shank 10, the accommodation space 14 is defined as illustrated in FIG. 10.

Figure 11:
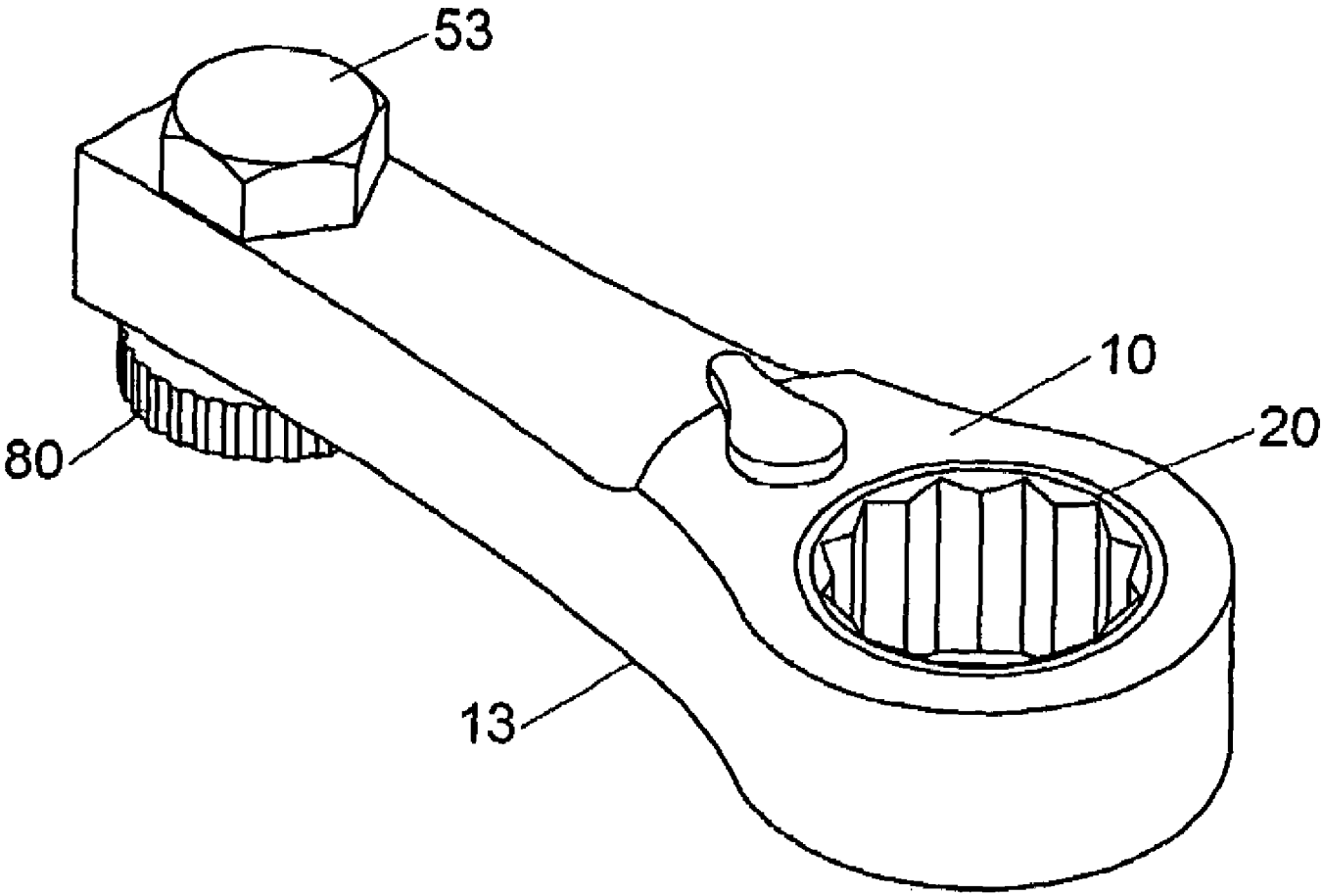
FIG. 11 is a perspective view of a fourth preferred embodiment of the present invention.

In a fourth preferred embodiment of the present invention as illustrated in FIG. 11, the second portion 53 of the second wheel member 50 may be related to a protruded hexagonal head for the second wheel member to be inserted to a ratchet ring spanner or a ring spanner.

Figure 12:
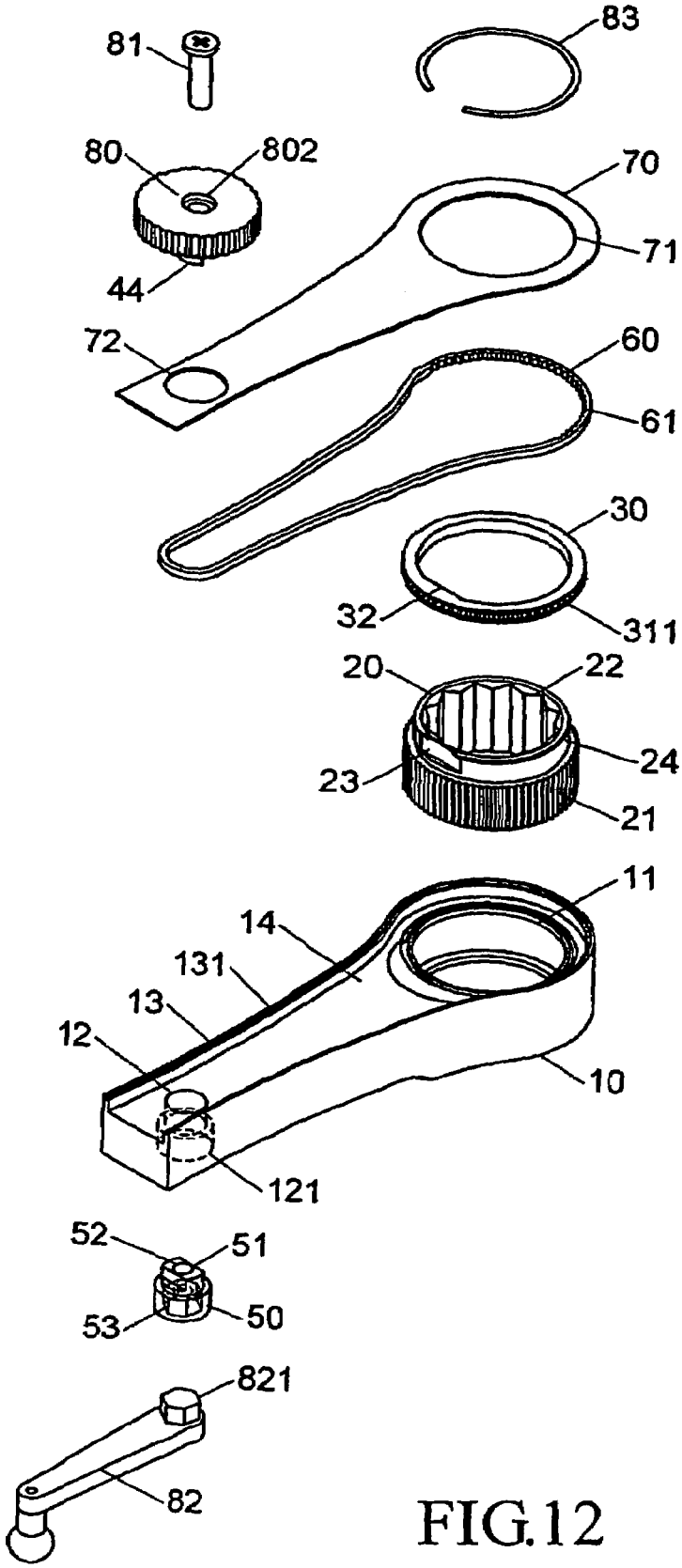
FIG. 12 is an exploded view showing a fifth preferred embodiment of the present invention.
Figure 13:
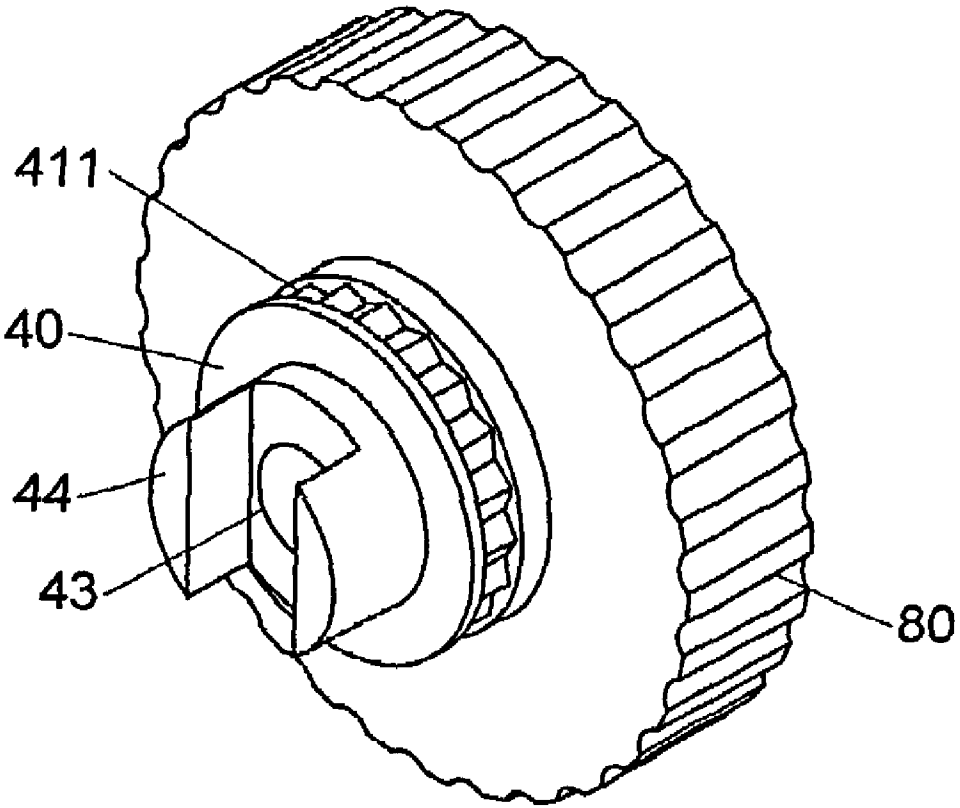
FIG. 13 is a perspective view showing a first wheel member and a second wheel member in the fifth preferred embodiment of the present invention.

The first wheel member 40 and the third wheel member 80 are integrated in a fifth preferred embodiment of the preset invention as illustrated in FIGS. 12 and 13.

Figure 14:
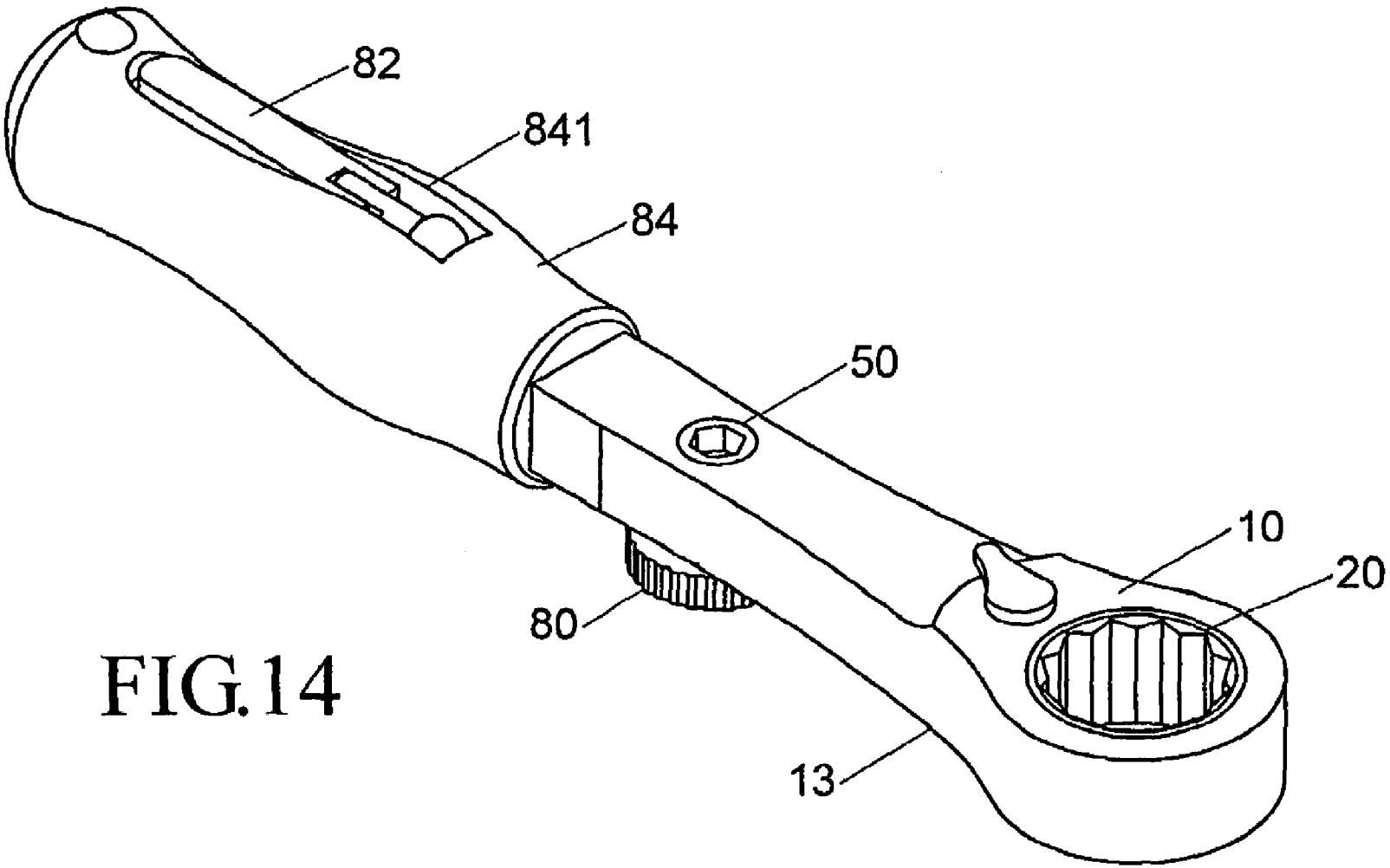
FIG. 14 is a perspective view of a sixth preferred embodiment of the present invention.

In a sixth preferred embodiment of the present invention as illustrated in FIG. 14, a handle 84 is fixed to the rear of the shank 10 and an accommodation channel 841 is defined in the handle 84 to store the crank 82 when not used. The crank 82 can be removed from the accommodation channel 841 and inserted into the hexagonal cavity 54 for use.

In the present invention, each of the toothed surfaces 311 and 411 may be formed between two flanges that are used to restrain the transmission member 60 so that the transmission member 60 is firmly engaged with the ring gear 30 and the first wheel member 40. The transmission member 60 of the present invention may be related to a toothed belt or chain and both of the gear ring 30 and the first wheel member 40 may be each related to a gear.

What is claimed is:

1. A ratchet box end wrench comprising:

a shank comprising a space defined in an end, a first pivot hole defined in another end and a second pivot hole in communication with the first pivot hole;

a ratchet comprising a ratchet portion disposed in the space, an axial portion extended from the ratchet portion, a locating surface formed on the axial portion and a locking groove defined in the axial portion;

a ring gear comprising a straight portion formed on an internal side and engaged with the locating surface and a toothed portion on an external side;

a first wheel member comprising a toothed surface formed on the periphery, a linking block formed on a side, a pivot formed on an opposite side and disposed in the first pivot hole and a linking trough defined in the pivot;

a belt comprising a toothed internal side engaged with both of the ratchet portion of the ratchet and the toothed surface of the first wheel member;

a second wheel member comprising a linking block formed on a side and disposed in the linking trough so that the first and second wheel members are rotational together, a screw hole defined in the linking block and a cavity defined in an opposite side;

a crank comprising a linking block disposed in the cavity of the second wheel so that the crank is operable to rotate the second wheel member;

a third wheel member comprising a cavity for receiving the linking block of the first wheel member so that the third wheel member is operable to rotate the first wheel member and a countersink hole in communication with the cavity thereof;

a fastener driven in the screw hole of the second wheel member through the countersink hole and cavity of the third wheel member, the through hole and linking trough of the first wheel member;

a covering plate comprising a first through hole through which the axial portion of the ratchet is inserted and a second through hole through which the linking block of the first wheel member is inserted, wherein the covering plate is retained on the shank by the third wheel member for covering the ratchet, the ring gear, the belt and the first and second wheel members; and a locking ring disposed in the locking groove of the ratchet for further retaining the covering plate on the shank.

2. A ratchet box end wrench according to claim 1, wherein the linking block of the first wheel member is non-circular, and the cavity of the third wheel member is correspondingly non-circular.

3. A ratchet box end wrench according to claim 2, wherein the linking block of the first wheel member is hexagonal, and the cavity of the third wheel member is correspondingly hexagonal.

4. A ratchet box end wrench according to claim 1, wherein the linking block of the crank is non-circular, and the cavity of the second wheel member is correspondingly non-circular.

5. A ratchet box end wrench according to claim 4, wherein the linking block of the crank is hexagonal, and the cavity of the second wheel member is correspondingly hexagonal.

6. A ratchet box end wrench according to claim 1, wherein the shank comprises a short wall formed thereon for restraining the belt, and the covering plate is located on the short wall.

7. A ratchet box end wrench according to claim 6, wherein the shank comprises a tall wall formed thereon for restraining the covering plate.

* * * * *